US006301332B1

(12) United States Patent
Rogers et al.

(10) Patent No.: US 6,301,332 B1
(45) Date of Patent: Oct. 9, 2001

(54) THERMAL FILTER FOR AN X-RAY TUBE WINDOW

(75) Inventors: Carey S. Rogers, Waukesha; Charles B. Kendall; Douglas J. Snyder, both of Brookfield; Brian D. Lounsberry, Thiensville, all of WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/723,932

(22) Filed: Nov. 28, 2000

Related U.S. Application Data

(63) Continuation of application No. 09/208,961, filed on Dec. 10, 1998, now Pat. No. 6,215,852.

(51) Int. Cl.[7] ..... H01J 35/16

(52) U.S. Cl. ..... 378/142; 378/141; 378/203

(58) Field of Search ..... 378/119, 121, 378/123, 127, 128, 129, 130, 140, 141, 142, 199, 200, 203

(56) References Cited

U.S. PATENT DOCUMENTS

| | | | |
|---|---|---|---|
| 2,665,391 | 1/1954 | Bleeksma | 313/59 |
| 2,952,790 | 9/1960 | Steen | 378/140 X |
| 3,018,398 | 1/1962 | Atlee | 378/140 |
| 3,752,990 | 8/1973 | Fischer | 250/503 |
| 4,045,699 | 8/1977 | Gunther | 313/59 |
| 4,119,234 | 10/1978 | Kotschak et al. | 220/2.1 R |
| 4,309,637 | 1/1982 | Fetter | 313/60 |
| 4,322,653 | 3/1982 | Bader et al. | 378/140 |
| 4,731,804 | 3/1988 | Jenkins et al. | 378/140 |
| 4,767,961 | 8/1988 | Koller et al. | 313/12 |
| 4,969,173 | 11/1990 | Valkonet | 378/136 |
| 5,128,977 | 7/1992 | Danos | 378/121 |
| 5,420,906 | 5/1995 | Smit et al. | 378/141 |
| 5,511,104 | 4/1996 | Mueller et al. | 378/125 |
| 5,563,923 | 10/1996 | Okada et al. | 378/138 |
| 5,677,943 | 10/1997 | Hoebel | 378/156 |
| 5,689,541 | 11/1997 | Schardt | 378/140 |
| 5,689,542 | 11/1997 | Lavering et al. | 378/142 |
| 5,732,123 | 3/1998 | Peralta et al. | 378/199 |
| 5,768,340 | 6/1998 | Geittner et al. | 378/159 |
| 6,005,918 | 12/1999 | Harris et al. | 378/140 |

FOREIGN PATENT DOCUMENTS

| | | | |
|---|---|---|---|
| 0 009 946-A1 | 4/1980 | (EP) | 35/16 |
| 0 924 742-A2 | 6/1999 | (EP) | 35/18 |

*Primary Examiner*—David P. Porta
(74) *Attorney, Agent, or Firm*—Kilpatrick Stockton LLP; Charles W. Calkins; James J. Bindseil

(57) ABSTRACT

A thermal energy storage and transfer assembly is disclosed for use in electron beam generating devices that generate residual energy. The residual energy comprises radiant thermal energy and kinetic energy of back scattered electrons. The thermal energy storage and transfer assembly absorbs and stores an amount of the residual energy to reduce the heat load on other components in the electron beam generating device. The thermal energy storage and transfer device comprises a body portion of a sufficient thermal capacity to permit the rate of transfer of the amount of the residual energy absorbed into the assembly to substantially exceed the rate of transfer of the amount of the residual energy out of the assembly. The assembly also comprises a heat exchange chamber filled with a circulating fluid that transfers the thermal energy out of the assembly. Additionally, in an x-ray generating device, an x-ray transmissive filter suitable for absorbing residual energy is positioned between the anode and an x-ray transmissive window. The filter reduces the exposure of the window to the residual energy. The filter may additionally comprise a coating layer that further reduces the exposure of the window to the residual energy.

10 Claims, 6 Drawing Sheets

THERMAL FILTER FOR AN X-RAY TUBE WINDOW

CROSS REFERENCE TO RELATED APPLICATIONS

This application is a continuation of U.S. application Ser. No. 09/208,961, filed with the U.S. Patent Office on Dec. 10, 1998 now U.S. Pat. No. 6,215,852.

BACKGROUND OF THE INVENTION

The present invention relates to a thermal energy management system, and more particularly, to a thermal energy storage and transfer assembly for gathering radiant thermal energy and kinetic energy of electrons, such as within an electron beam generating device.

Electron beam generating devices, such as x-ray tubes and electron beam welders, operate in a high temperature environment. In an x-ray tube, for example, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is radiated to other components within the vacuum vessel of the x-ray tube, and is removed from the vacuum vessel by a cooling fluid circulating over the exterior surface of the vacuum vessel. Additionally, some of the electrons back scatter from the target and impinge on other components within the vacuum vessel, causing additional heating of the x-ray tube. As a result of the high temperatures caused by this thermal energy, the x-ray tube components are subject to high thermal stresses which are problematic in the operation and reliability of the x-ray tube.

Typically, an x-ray beam generating device, referred to as an x-ray tube, comprises opposed electrodes enclosed within a cylindrical vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary. The target track, or impact zone, of the anode is generally fabricated from a refractory metal with a high atomic number, such as tungsten or tungsten alloy. Further, to accelerate the electrons, a typical voltage difference of 60 kV to 140 kV is maintained between the cathode and anode assemblies. The hot cathode filament emits thermal electrons that are accelerated across the potential difference, impacting the target zone of the anode at high velocity. A small fraction of the kinetic energy of the electrons is converted to high energy electromagnetic radiation, or x-rays, while the balance is contained in back scattered electrons or converted to heat. The x-rays are emitted in all directions, emanating from the focal spot, and may be directed out of the vacuum vessel. In an x-ray tube having a metal vacuum vessel, for example, an x-ray transmissive window is fabricated into the metal vacuum vessel to allow the x-ray beam to exit at a desired location. After exiting the vacuum vessel, the x-rays are directed to penetrate an object, such as human anatomical parts for medical examination and diagnostic procedures. The x-rays transmitted through the object are intercepted by a detector and an image is formed of the internal anatomy. Further, industrial x-ray tubes may be used, for example, to inspect metal parts for cracks or to inspect the contents of luggage at airports.

As mentioned above, many of the incident electrons are not converted to x-rays, and are deflected away from the target in random directions. For example, up to about 50 percent of the incident primary electrons are back scattered from a tungsten anode target. These back scattered electrons travel on a curvilinear path through the electric field between the cathode and anode until they impact another structure. These electrons interact with the electric field and space charge, causing their initial trajectories to be altered in a complicated, but predictable, manner. The electrons back scatter and bounce off of the internal components of the x-ray tube, transferring kinetic energy, until all of their energy is depleted. In addition to depositing thermal energy into tube components, the impact of back scattered electrons also produces additional off-focal x-rays. This production of off-focal x-ray radiation degrades the image quality if it is allowed to exit the vacuum vessel x-ray transmissive window.

The path of the off-focal radiation and the back scattered electrons may be influenced by the electrical potential configuration of the x-ray tube. In a bi-polar configuration, the cathode is maintained at a negative potential and the anode at a positive potential relative to ground, thereby comprising the total voltage drop across the cathode to anode gap. In this configuration, a large fraction of the initially back scattered electrons from the anode are drawn back to the anode by the electrostatic potential. On the other hand, in a uni-polar design the anode and vacuum vessel are grounded and the cathode is maintained at a high negative potential. In the uni-polar configuration, the back scattered electrons are not drawn back to the anode or attracted to the frame. Therefore, in a uni-polar configuration, a larger fraction of the back scattered electron energy can be beneficially collected and not allowed to return to the anode, thus greatly enhancing the thermal performance of the anode and decreasing the amount of off-focal radiation exiting through the transmissive window.

Since the production of x-rays in a medical diagnostic x-ray tube is by its nature a very inefficient process, the components in x-ray generating devices operate at elevated temperatures. For example, the temperature of the anode focal spot can run as high as about 2700° C., while the temperature in the other parts of the anode may range up to about 1800° C. Additionally, the components of the x-ray tube must be able to withstand the high temperature exhaust processing of the x-ray tube, at temperatures that may approach approximately 450° C. for a relatively long duration.

To cool the x-ray tube, the thermal energy generated during tube operation must be transferred from the anode through the vacuum vessel and be removed by a cooling fluid. The vacuum vessel is typically enclosed in a casing filled with circulating, cooling fluid, such as dielectric oil. The casing supports and protects the x-ray tube and provides for attachment to a computed tomography (CT) system gantry or other structure. Also, the casing is lined with lead to provide stray radiation shielding. The cooling fluid often performs two duties: cooling the vacuum vessel, and providing high voltage insulation between the anode and cathode connections in the bi-polar configuration. The performance of the cooling fluid may be degraded, however, by excessively high temperatures that cause the fluid to boil at the interface between the fluid and the vacuum vessel and/or the transmissive window. The boiling fluid may produce bubbles within the fluid that may allow high voltage arcing across the fluid, thus degrading the insulating ability of the fluid. Further, the bubbles may lead to image artifacts, resulting in low quality images. Thus, the current method of relying on the cooling fluid to transfer heat out of the x-ray tube may not be sufficient.

Similarly, excessive temperatures can decrease the life of the transmissive window, as well as other x-ray tube components. Due to its close proximity to the focal spot, the x-ray transmissive window is subject to very high heat loads resulting from thermal radiation and back scattered electrons. These high thermal loads on the transmissive window necessitate careful design to insure that the window remains intact over the life of the x-ray tube, especially in regard to vacuum integrity. The transmissive window is an important hermetic seal for the x-ray tube. The high heat loads cause very large and cyclic stresses in the transmissive window and can lead to premature failure of the window and its hermetic seals. Further, as mentioned above, direct contact with the cooling fluid can cause the fluid to boil as it flows over the window. Also, direct contact with a window that is too hot can cause degraded hydrocarbons from the fluid to become deposited on the window surface, thereby reducing image quality. Thus, this solution to cooling the transmissive window may not be satisfactory.

In addition to the thermal effects of back scattered electrons, they can also diminish image quality via the production of non-diagnostic off-focal radiation. Also, x-rays produced by back scattered electrons have a much lower energy spectral content that is not diagnostically beneficial and adds to the patient radiation dose. Thus, it is desirable to prevent the unnecessary x-ray dose of off-focal x-rays from reaching the patient.

The prior art has primarily relied on quickly dissipating thermal energy by using a circulating, coolant fluid within structures contained in the vacuum vessel. The coolant fluid is often a special fluid for use within the vacuum vessel, as opposed to the cooling fluid that circulates about the external surface of the vacuum vessel. Other methods have been proposed to electromagnetically deflect back scattered electrons so that they do not impinge on the x-ray window. These approaches, however, do not provide for significant levels of energy storage and dissipation.

Additionally, these approaches become even more problematic when combined with new techniques in x-ray computed tomography, such as fast helical scanning, that require vastly more x-ray flux than previous techniques. Due to the inherent poor efficiency of x-ray production, the increased x-ray flux is purchased at the expense of greatly increased heat load that must be dissipated. As the power of x-ray tubes continues to increase, the heat transfer rate to the coolant may exceed the heat flux absorbing capabilities of the coolant.

Additionally, these methods do not greatly reduce off-focal radiation or the back scattered electron heat load on the anode. A previous device utilizes an anode hood structure to collimate off-focal radiation. This device has the serious drawback that it relies on radiative cooling and would typically have to operate at very high temperature to transfer the absorbed back scattered electron energy. Other methods employ convection devices which circulate a coolant fluid through a shield within the vacuum vessel. In addition, fluid-cooled shrouds that cover rotating anodes have been used to absorb heat. These approaches rely on thin-walled metal structures to absorb thermal energy and immediately transfer the energy out of the system through a circulating fluid. These methods, however, disadvantageously result in the coolant being subjected to very high heat fluxes and possibly to boiling. Boiling heat transfer is very complicated and can result in high fluid pressure drops. Also, typical prior art devices have high incident heat fluxes, which may result in extreme localized temperatures that may lead to melting of the thin-walled structure and failure of the x-ray tube. Therefore, it is desirable to provide a thermal energy transfer assembly that overcomes the above-stated problems.

SUMMARY OF THE INVENTION

The present invention comprises a thermal storage assembly having a body portion of a sufficient thermal capacity to absorb and store substantially all of the residual energy generated within the vacuum vessel of an x-ray generating device. The residual energy comprises radiant thermal energy from the hot anode of the x-ray generating device and kinetic energy of back scattered electrons that deflect off of the anode. Additionally, the thermal storage assembly decreases the amount of off-focal radiation exiting the generating device. Further, the thermal storage assembly prevents a large fraction of the back scattered electrons from returning to the anode, thereby, allowing the x-ray generating device to run for longer periods between mandatory cooling delays during a radiographic examination. The thermal storage assembly comprises a substantially solid body portion that acts as a heat sink, preferably comprising a copper or copper alloy. Further, the thermal capacity of the thermal storage assembly allows the heat transfer rate to the thermal storage assembly to greatly exceed the heat transfer rate from the thermal storage assembly and out of the vacuum vessel during the radiographic examinations.

In operation, the thermal storage assembly is cooled via a circulation of a coolant fluid, such as a dielectric oil, through a heat exchange chamber in the thermal storage assembly. The coolant fluid within the heat exchange chamber is preferably a portion of a body of cooling fluid that circulates about the vacuum vessel to cool the x-ray generating device. Preferably, the heat exchange chamber is formed at the periphery of the thermal storage assembly, away from the interior surface of the thermal storage assembly that is absorbing the back scattered electrons and radiant thermal energy. This arrangement allows the absorbed thermal energy to diffuse throughout the large mass of the body, thereby lowering the heat flux and surface temperature at the coolant interface. The heat transfer rate to the coolant fluid in the heat exchange chamber, or the cooling rate, is much less than the rate at which heat is being absorbed by the thermal storage assembly. The excess absorbed energy is safely stored in the body of the thermal storage assembly until the examination is complete. In contrast to prior art devices that require that all of the thermal energy be removed in real time during the x-ray exposure, the present device is thermally "thick" and stores the back scattered and radiant energy during the x-ray exposure. This eliminates the need for, and inherent dangers of, boiling heat transfer. Thus, the present invention greatly reduces the thermal stress at the coolant interface for a given heat flux compared to thin-walled structures.

Additionally, the present invention comprises an x-ray transmissive filter that reduces thermal energy received by an x-ray transmissive window. The transmissive window is typically disposed in either the thermal storage assembly or the vacuum vessel, forming a hermetic seal. The filter is disposed between the anode and an x-ray transmissive window, to shield the window from the residual energy emanating from the anode. In contrast to the window, the filter joint does not need to be a hermetic seal. The filter thus advantageously reduces the exposure of the transmissive window to heat load and thermal stresses, improving the reliability of the vacuum-sealed joint between the transmissive window to either the body portion of the thermal storage assembly or the vacuum vessel.

Also, the present invention comprises an x-ray transmissive coating layer applied to at least one surface of the filter. The coating layer comprises a highly reflective, high atomic number material that reflects the incident residual energy. The high atomic number coating layer reduces the thermal energy absorbed by the window, thereby reducing thermal stresses. Thus, the coating layer further increases the shielding effect of the filter to enhance the thermal protection of the window.

Further, the present invention may comprise an x-ray generating device, such as an x-ray tube, incorporating the invention described above. Similarly, the present invention may comprise an x-ray system, such as a computed tomography system, having an x-ray generating device comprising the invention described above.

DETAILED DESCRIPTION OF THE INVENTION

The present invention comprises a thermal energy management system that may be utilized in electron beam generating devices. The invention is described in reference to an x-ray generating device, such as an x-ray tube in a computed tomography system. X-ray generating devices employing the present invention may also be utilized in other x-ray applications, such as radiography, fluoroscopy, vascular imaging, mammography, mobile x-ray devices, as well as dental and industrial imaging systems. Further, as one skilled in the art will realize, the present invention may be utilized in other electron beam generating devices, such as electron beam welders.

Figure 1:
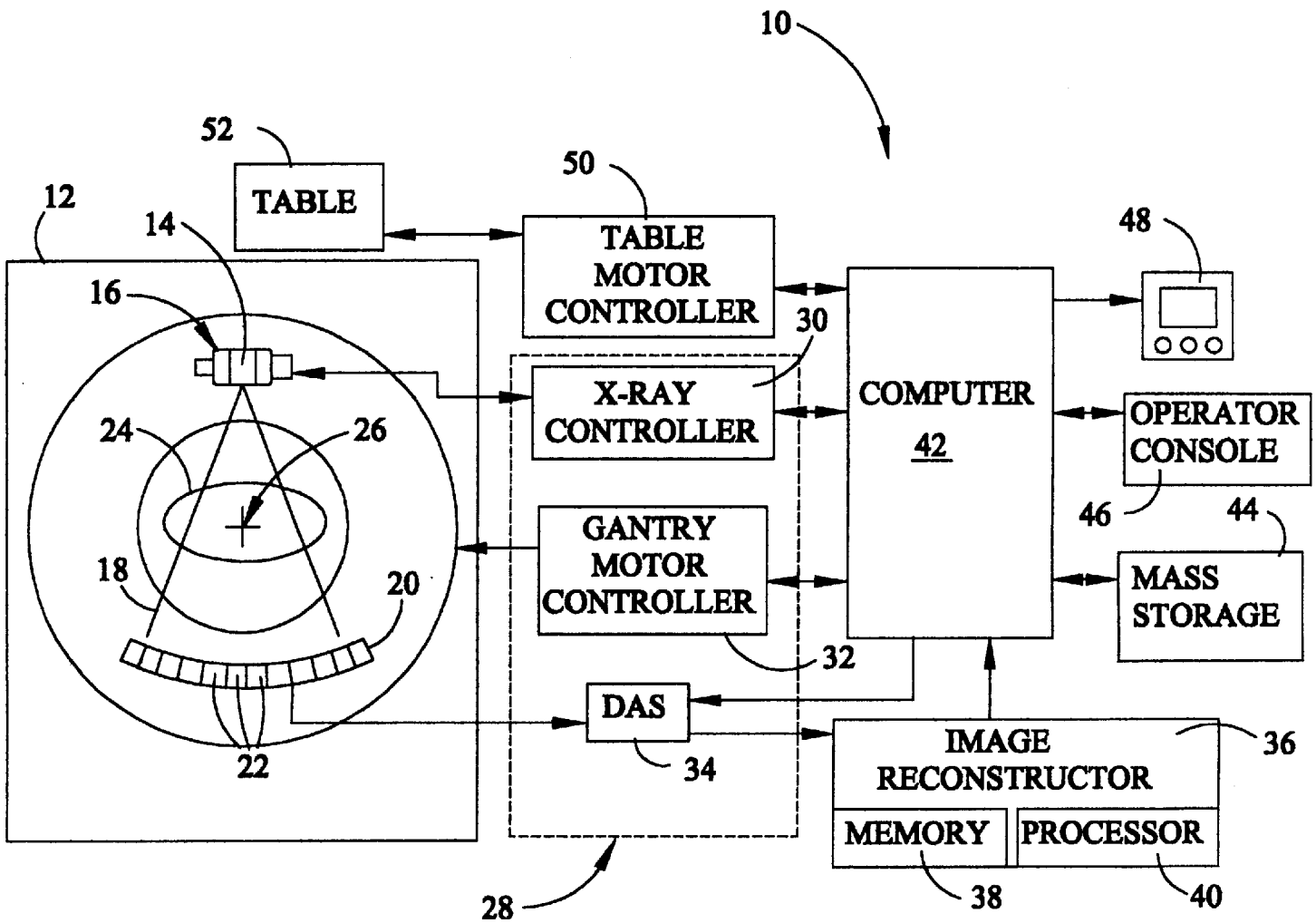
FIG. 1 is a schematic diagram representing a computed tomography system comprising an x-ray generating device having a thermal storage assembly of the present invention.

Referring to FIG. 1, a typical computed tomography (CT) imaging system 10 comprises a gantry 12 representative of a "third generation" CT scanner. Gantry 12 includes housing unit 14 that holds an x-ray generating device 16, for example, that projects a beam of x-rays 18 toward a detector array 20 on the opposite side of gantry 12. Detector array 20 is divided into channels formed by detector elements 22 which together sense the projected x-rays that pass through a medical patient 24 or other imaging object. Each detector element 22 produces an electrical signal that represents the intensity of an impinging x-ray beam and hence the attenuation of the beam as it passes through patient 24. During a scan to acquire x-ray projection data, gantry 12 and the components mounted thereon rotate about an axis of rotation 26.

Rotation of gantry 12 and the operation of x-ray generating device 16 are governed by a control mechanism 28 of CT system 12. Control mechanism 28 includes an x-ray controller 30 that provides power and timing signals to x-ray generating device 16 and a gantry motor controller 32 that controls the rotational speed and position of gantry 12. A data acquisition system (DAS) 34 in control mechanism 28 samples analog projection data from detector elements 22 and converts the analog data to digital projection data for subsequent processing. An image reconstructor 36 receives into its memory 38 the digitized x-ray projection data from DAS 34 and comprises a processor 40 that performs the high speed image reconstruction algorithm as defined by the program signals stored in the memory. The reconstructed image is applied as an input to a computer 42 which stores the image in a mass storage device 44.

Computer 42 also receives commands and scanning parameters from an operator via console 46 that has a keyboard. An associated cathode ray tube display 48 allows the operator to observe the reconstructed image and other data from computer 42. The operator supplied commands and parameters are used by computer 42 to provide control signals and information to DAS 34, x-ray controller and gantry motor controller 32. In addition, computer 42 operates a table motor controller 50 which controls a motorized table 52 to position patient 24 in gantry 12. For an axial scan, also known as a stop-and-shoot scan, table 52 indexes patient 24 to a location, and allows gantry 12 to rotate about the patient at the location. In contrast, for a helical scan, table 52 moves patient 24 at a table speed, s, equal to a displacement along the z-axis per a rotation of the x-ray generating device 10 about gantry 12.

Figure 2:
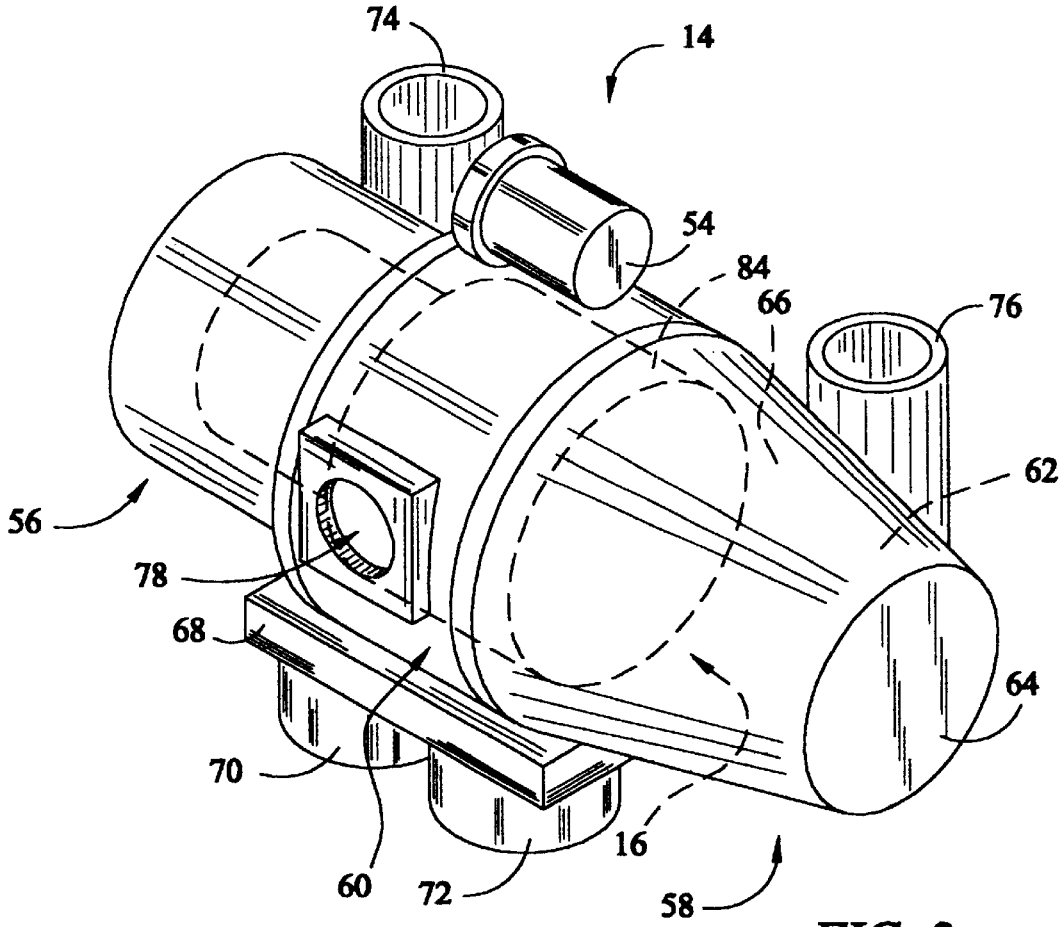
FIG. 2 is a perspective view of a representative housing having an x-ray generating device or x-ray tube positioned therein.

Referring to FIG. 2, a typical housing unit 14 comprises an oil pump 54, an anode end 56, a cathode end 58, and a center section 60 positioned between the anode end and cathode end, which contains the x-ray generating device or x-ray tube 16. The x-ray generating device 16 is enclosed in a fluid chamber 62 within lead-lined casing 64. The chamber 62 is typically filled with fluid 66, such as dielectric oil, but other fluids including air may be utilized. Fluid 66 circulates through housing 14 to cool x-ray generating device 16 and to insulate casing 64 from the high electrical charges within the x-ray generating device. A radiator 68 for cooling fluid 66 is positioned to one side of the center section and may have fans 70 and 72 operatively connected to the radiator for providing cooling air flow over the radiator as the hot oil circulates through it. Pump 54 is provided to circulate fluid 66 through casing 64 and through radiator 68, etc. Electrical connections in communication with the x-ray generating device 14 are provided through the anode receptacle 74 and cathode receptacle 76. A window 78 is provided for emitting x-rays from casing 64.

Figure 3:
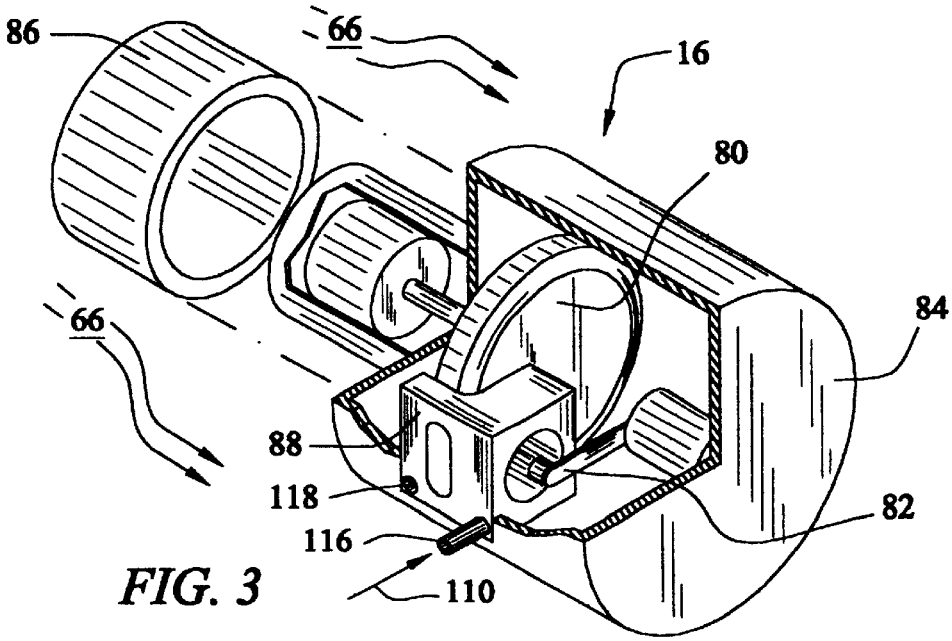
FIG. 3 is a sectional perspective view with the stator exploded to reveal a portion of the anode assembly of an x-ray generating device incorporating the thermal storage assembly of the present invention.
Figure 4:
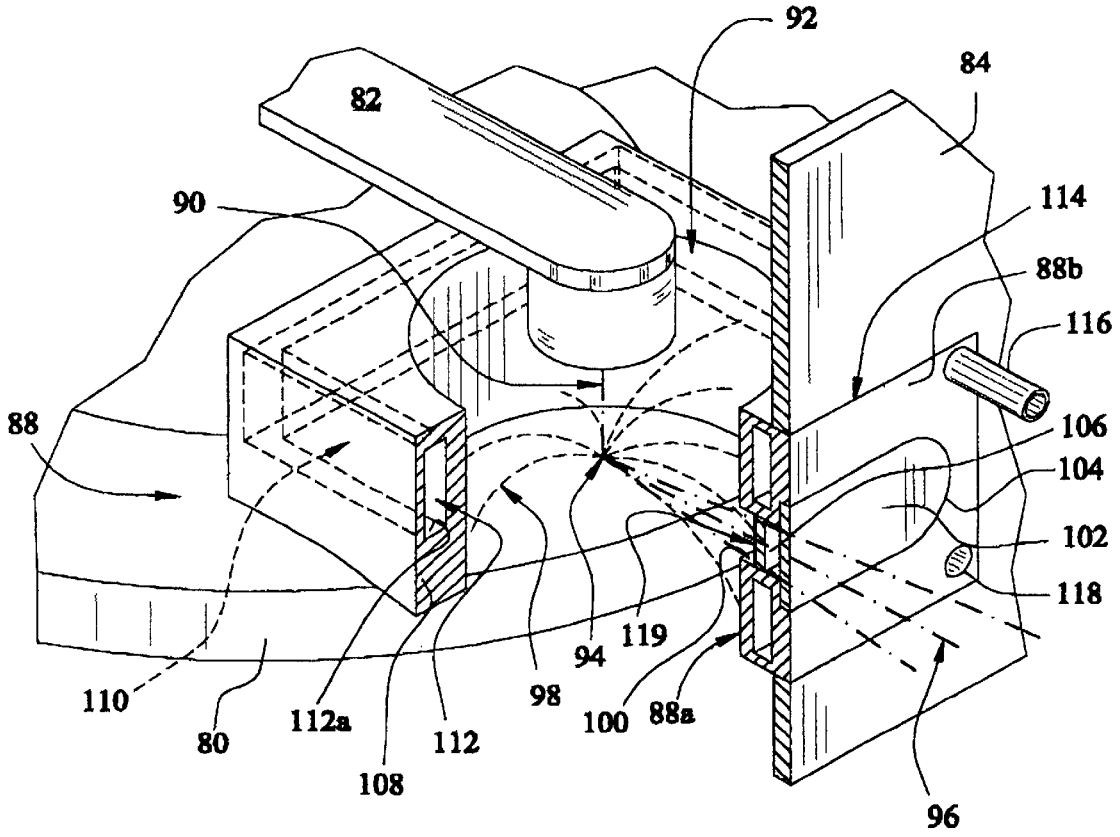
FIG. 4 is a sectional perspective view of an embodiment of an x-ray generating device incorporating a thermal storage assembly.

Referring to FIGS. 3 and 4, a typical x-ray generating device 16 comprises rotating target anode assembly 80 and a cathode assembly 82 disposed in a vacuum within vessel 84. A stator 86 is positioned over vacuum vessel 84 adjacent to rotating target anode 80. A thermal storage assembly 88 is interposed between target anode 80 and cathode 82. Upon energization of the electrical circuit connecting cathode assembly 82 and anode assembly 80, a stream of electrons 90 are directed through central cavity 92 and accelerated toward anode assembly 80. The stream of electrons 90 strike a focal spot 94 on the anode assembly 80 and produce high frequency electromagnetic waves 96, or x-rays, and residual energy. The residual energy is absorbed by the components within x-ray generating device 16 as heat. X-rays 96 are directed through the vacuum toward an aperture 100 in thermal storage assembly 88. Aperture 100 collimates x-rays 96, thereby reducing the radiation dosage received by patient 24 (FIG. 1).

Disposed within aperture 100 is x-ray transmissive window 102, comprising a material that efficiently allows the passage of x-rays 96. Preferably, transmissive window 102 only allows the transmission of x-rays 96 having a useful, diagnostic amount of energy. For example, in computed tomography applications, the useful diagnostic energy range for x-rays 96 is from about 60 keV to about 140 keV. Although, as will be realized by one skilled in the art, the useful diagnostic range may vary by application. Transmissive window 102 is hermetically sealed to thermal storage assembly 88 at joint 104, such as by vacuum brazing or welding. Seal 104 serves to maintain the vacuum within vacuum vessel 84. Also, filter 106 is disposed between anode assembly 80 and transmissive window 102, mounted within aperture 100. Similar to transmissive window 102, filter 106 allows the passage of diagnostic x-rays 96. Thus, x-ray generating device 16 generates residual energy and x-rays 96 that are directed out of the x-ray generating device through filter 106 and window 102.

Typically, less than 1% of the total power of x-ray generating device 16 is converted to x-rays 96. The residual energy comprises the remaining power, which is eventually converted to heat that is absorbed by the components within x-ray generating device 16. The residual energy comprises radiant thermal energy from anode assembly 80 and kinetic energy of back scattered electrons 98 that deflect off of the anode assembly. Typically, about 70% of the total x-ray generating device power is converted to radiant thermal energy absorbed as beat by anode assembly 80. The other approximately 30% of the total power is kinetic energy of back scattered electrons 98. This kinetic energy ends up being converted to thermal energy upon impacting with components in vacuum vessel 84. Thus, most of the total power of x-ray generating device 16 ends up as thermal energy within the device.

Thermal storage assembly 88 comprises a body portion 108 having a thermal capacity to absorb and store substantially all of an amount of residual or thermal energy resulting from absorbed back scattered electrons 98 and radiant thermal energy emanating from anode 80. The amount of residual energy stored by thermal storage assembly 88 may preferably comprise about 10%–40% of the total power of x-ray generating device 16. Thermal storage assembly 88 absorbs and stores substantially all of the kinetic energy of back scattered electrons 98. As such, thermal storage assembly 88 stores up to about 95% of the kinetic energy, or up to about 28.5%–38% of the total power of x-ray generating device 16. The 5% of the kinetic energy not absorbed is radiated or re-back scattered to anode assembly 80 or vacuum vessel 84. Similarly, thermal storage assembly 88 absorbs and stores some of the radiant thermal energy absorbed as heat by anode assembly 80. As such, thermal storage assembly 88 stores up to about 10% of the radiant thermal energy, or up to about 7% of the total power. The remaining 90% of the radiant thermal energy is radiated to vacuum vessel 84 or conducted away. Thus, thermal storage assembly has a sufficient thermal capacity to absorb and store up to about 45% of the total power of x-ray generating device 16.

The absorbed and stored thermal energy is eventually transferred to a coolant fluid 110 circulating within a heat exchange chamber 112. Coolant fluid 110 ultimately transfers the absorbed and stored thermal energy out of the system. However, the thermal capacity of body portion 108 advantageously allows the rate of thermal energy transfer to circulating fluid 110 to be significantly less than the rate of thermal energy transfer to thermal energy storage device 88. This thermal capacity enables thermal storage device 88 to have an incoming heat transfer rate at interior surface that greatly exceeds the outgoing heat transfer rate at coolant interface 112*a*. This is not possible with the typical, thin-walled prior art devices where the incoming heat transfer rate is limited by the outgoing heat transfer rate. Thus, thermal storage assembly 88 immediately absorbs and stores a large amount of residual energy to help cool anode assembly 80, and advantageously later transfers the absorbed energy out of x-ray generating device 16.

Thermal storage assembly 88 preferably comprises a structure fabricated of a material having a high thermal diffusivity and heat storage capacity, preferably such as copper or a copper alloy like the GlidCop® alloy. The material used for the body of the thermal storage assembly must be able to withstand high heat fluxes in a vacuum. The ultimate limiting condition for the material composition of thermal storage assembly 88 is that the interior surface receiving the heat flux does not melt. A transient heating figure-of-merit can be used to compare different materials. For a material with a melting point $T_m$ and a surface temperature of $T_0$ before the x-ray pulse, the limiting heat flux, q", is proportional to:

$$q'' \propto \sqrt{\frac{\rho C_p k}{t}}\,(T_m - T_0) \tag{1}$$

where ρ is the material density, $C_p$ the specific heat, k the thermal conductivity, and t is the time the part is exposed to the heat flux. The materials with the highest transient heating figures of merit are the refractory metals, such as molybdenum and tungsten. The resistance to surface melting for copper under a given heat flux is about 75% that of molybdenum and 3 times better than stainless steel, which is a typical material for vacuum vessel 84.

Another figure-of-merit important in material selection deals with the evaporation of the material. Evaporated neutral atoms can cause electrical breakdown if they deposit on the high-voltage insulators. Also, evaporated neutral atoms can cause unwanted attenuation of the x-rays if they deposit on transmissive window 102. In general, for a plate of thickness, d, with a heat flux q" on one side, and convective cooling on the opposite side, the temperature difference across the plate is governed by the following relation:

$$q'' \propto \frac{T_0 - T_f}{1/h + d/k} \quad (2)$$

where h is the heat transfer coefficient, k is the thermal conductivity and $T_f$ is the initial temperature of the coolant fluid. If $T_0$ is the maximum allowable surface temperature, then the limiting heat flux can be calculated as a function of the heat transfer coefficient. For very large heat transfer coefficients, copper is the highest ranking material. For heat transfer coefficients typical of single-phase convection, it is found that refractory metals are best for thin structures and copper is preferred for thick (>1 cm) structures.

Structures subjected to high heat fluxes must also be able to withstand the resulting large thermal stress. A thermal stress figure-of-merit for transient heating that defines a maximum heat flux before the elastic limit is reached is given by:

$$q'' \propto \frac{(1-\nu)\sigma_y\sqrt{\rho C_p k}}{E\alpha} \quad (3)$$

where ν is Poisons'coefficient, $\sigma_{y\ is}$ the material yield strength, ρ is the density, $C_p$ the specific heat, k the thermal conductivity, E the elastic modulus, and α the coefficient of thermal expansion. For transient heating, graphite and a molybdenum alloy like TZM perform the best, with beryllium, tungsten, and copper a distant second.

For steady-state heating, a thermal stress figure-of-merit can be defined as:

$$q'' \propto \frac{2(1-\nu)k\sigma_y}{E\alpha} \quad (4)$$

Again, graphite and TZM are the best materials, with copper, aluminum, and beryllium in the middle. Stainless steel is a very poor material for both steady-state and transient heating. Thus, copper and copper alloys score relatively high in all of the figures-of-merit discussed above, and they are also very good materials for use in vacuum.

Body portion 108 advantageously has a mass or volume effective to achieve a high thermal storage capacity that beneficially allows the heat generation rate at interior surface 88*a* to exceed the heat transfer rate to coolant fluid 110. Body portion 108 advantageously comprises a substantial part of the entire volume of thermal storage assembly 88 in order to provide sufficient heat storage capacity. Compared to prior art devices, which are substantially hollow and require immediate heat transfer capabilities, thermal storage assembly 88 is substantially solid. Body portion 108 preferably comprises greater than about 60%, more preferably greater than about 70%, and most preferably greater than about 80% of the volume of thermal storage assembly 88. As a result, thermal storage assembly 88 beneficially acts as a heat sink for thermal energy generated in x-ray generating device 16 by back scattered electrons 98 and radiant thermal energy from anode assembly 80, while providing a thermal storage capacity that eliminates the necessity of immediately transferring the thermal energy to coolant fluid 110. Thus, the large volume of body portion 108 beneficially provides a large thermal capacity that allows the thermal energy transfer rate from the body portion to fluid 110 to be substantially less than the thermal energy transfer rate to the body portion from back scattered electrons 98 and radiant thermal energy from anode 80.

As mentioned above, the residual energy comprises radiant thermal energy from the heated anode assembly 80 and kinetic energy of back scattered electrons 98. Back scattered electrons 98 then collide with the various components within x-ray generating device 16, including re-impacting with anode 80 and producing off-focal x-rays, and transferring thermal energy. Thus, the thermal energy from back scattered electrons 98 and from the radiant energy of anode 80 cause high temperatures and thermal stresses in the x-ray generating device components.

Transmissive window 102, in particular, is sensitive to this heat from the residual energy due to its close proximity to focal spot 94. Transmissive window 102 is typically formed of a thin plate of relatively low atomic number material, such as beryllium, aluminum, glass or titanium. Since transmissive window 102 typically forms part of the exterior surface of vacuum vessel 84, joint 104 must remain vacuum tight throughout the life of x-ray generating device 16. High heat loads resulting from back scattered electrons 98 and thermal radiation from the hot anode 80 cause very large thermal stresses in transmissive window 102, which may lead to premature failure. Additionally, vacuum vessel 84 and transmissive window 102 are typically cooled by fluid 66, such as transformer oil or dielectric oil. High temperatures on transmissive window 102 can cause fluid 66 at the surface of the window to boil, resulting in image artifacts and possible fluid degradation.

Thermal storage assembly 88 reduces these thermal stresses by intercepting back scattered electrons 98 and radiant thermal energy from anode 80, and absorbing and storing them. Preferably, thermal storage assembly 88 is able to store an amount of thermal energy corresponding to substantially all of the absorbed residual energy during the time interval of the x-ray exposure. The relationship of energy absorbed by thermal storage assembly 88 may be defined as follows. The total of the x-ray generating device power absorbed by assembly 88 results from the absorbed residual energy, and may be denoted as Q. The present invention advantageously provides a heat rate storage capacity, $q_s$, that substantially exceeds the heat rate transfer capacity, $q_t$, out of thermal storage assembly 88. The energy transfer equation for the present invention is defined by:

$$Q = q_s + q_t \quad (5)$$

where $$q_s = mC_p\frac{dT}{dt} \quad (6)$$

and $$q_t = hA_s\Delta T \quad (7)$$

where m is the mass in kilograms (kg) of the body of thermal storage assembly 88, $C_p$ is the material specific heat in J/kg/° C., dT/dt is the time rate of change of the body temperature, h is the heat transfer coefficient in $W/m^2/°$ C. of heat exchange chamber 112 (which varies with the dimensions of the chamber and the type of coolant fluid 110 that is used), $A_s$ is the area in $m^2$ of coolant interface 112*a*, and ΔT is the temperature difference in ° C. between the surface of coolant interface 112*a* and fluid 110. In applying the above equations to operational situations, typically the variables m, h and $A_s$ are varied to develop a solution. The solid structure of thermal storage assembly 88 acts as a heat sink, beneficially allowing for storage of thermal energy during the high power transient operation of the x-ray generating device 16.

The stored energy can then be beneficially removed from body portion 108 of thermal storage assembly 88 in between radiographic examinations by the circulating coolant fluid 110.

Ideally, thermal storage assembly 88 has the heat rate storage capacity, $q_s$, to store substantially all of the power Q from the absorbed residual energy incident on interior surface 88*a* during a typical scanning sequence. In other words, thermal storage assembly 88 absorbs an amount of the power from electron beam 90 that is not converted to x-rays 96 and that radiates or back scatters to interior surface 88*a*. Preferably, the amount of power or residual energy absorbed, Q, by thermal storage assembly 88 is in the range of about 10%–40%, more preferably 15%–40%, and most preferably 25%–40% of the total power of x-ray generating device 16. Advantageously, this results in an increased duty factor of x-ray generating device 16 of a comparable amount.

The increased duty factor enables x-ray generating device to be in operation for longer durations, thereby increasing patient throughput and examination efficiency. For example, the present invention may enable x-ray generating device 16 to operate at the following total power level and exposure time, respectively: about 0–12 kW for continuous operation; about 30 kW for up to about 5 minutes; about 65 kW for up to about 30 sec; and about 78 kW for up to about 10 sec. Thus, the present invention advantageously increases the efficiency of x-ray generating device 16.

The total power of x-ray generating device 16 in Watts (W) is equal to the product of the accelerating potential (kV) and the primary beam electron current (mA) from cathode assembly 82. Typically, in operation the total power may range from about 10 kW to 78 kW. The total power is based on an accelerating potential or voltage difference ranging from about 60 kV to 140 kV, and a current ranging from about 100 mA to 600 mA. Thus, the amount of power absorbed, Q, by thermal storage assembly 88 based on the above percentages ranges from about 1 kW to 31 kW, more preferably 1.5 kW to 31 kW, and most preferably 2.5 kW to 31 kW.

Equation 6, where $q_s = m\ Cp\ dT/dt$, may be used to determine the characteristics of a thermal storage assembly capable of handling a given absorbed power Q. As one skilled in the art will realize, there are numerous ranges for the variables in Equation 6, thereby providing various permutations for any variable for which a solution is desired. For example, although not intended to be limiting, in a preferred operational scenario mass m may vary from about 4 kg to 7 kg; Cp may vary from about 385 to 450 J/kg/° C.; dT may vary from about 0 to 750° C.; and dt may vary from about 0 to 600 seconds (sec). The variable Cp, which varies with temperature, is set by the material of thermal storage assembly 88. Similarly, the variable dT is set by the temperature rise limit of the material. The variable di is set by the time of the x-ray exposure. Generally, mass m may be varied so that the ratio dT/dt does not get too large. Thus, as is evident to one skilled in the art, the parameters of Equation 6 may be varied to suit the operational conditions.

What follows is a specific example to show one possible solution using Equation 6. This example is not intended to be limiting. Given an x-ray generating device having a total power of 65,000 Watts and 30% collection by the thermal storage assembly, the thermal storage assembly must handle 65,000×(0.3)=19,500 W. Given that the exposure lasts for 30 sec and allowing the average temperature of the thermal storage assembly to rise by 300° C. So Q=19,500 W, dT=300° C. and dt=30 sec, and for copper Cp=385 J/kg/° C. Therefore, the required mass of the body of thermal storage assembly, m, is about 5 kg in this specific example.

Actually, somewhat less than 5 kg may be utilized due to the heat rate transfer capacity, $q_t$, of thermal storage assembly 88. Because the coolant fluid 110 is removing some fraction of the 19,500 W during the 30 sec exposure, thermal storage assembly 88 is not required to store all of the absorbed power, Q. However, the present invention utilizes the heat rate storage capacity, $q_s$, to store substantial amounts of the absorbed power Q, thereby allowing $q_s$ to be significantly greater than $q_t$. For example, although not intended to be limiting, the ratio of $q_s$ to $q_t$ may range from about 1:1 to 5:1 or more, depending on the operational conditions and the design of the assembly. This avoids the problems, such as boiling fluid or possible meltdowns of thin-walled structures, associated with devices that require the real time removal of all of the absorbed power. Thus, the present invention provides two destinations for the transfer of thermal energy: temporary storage within the mass of the thermal storage assembly and real time convection to the coolant fluid.

The present invention beneficially allows x-ray generating device 16 to operate for a longer duration, while the normal delays between x-ray beam generation are advantageously utilized to transfer the excess thermal energy. Thus, thermal storage assembly 88 advantageously stores thermal energy in excess of the thermal energy transfer rate to coolant fluid 110.

A portion of outside surface 88*b* of thermal storage assembly 88 may form part of the exterior surface of vacuum vessel 84. Alternatively, as one skilled in the art will realize, thermal storage assembly 88 may be completely enclosed in vacuum vessel 84. Thermal storage assembly 88 is preferably mated with vacuum vessel 84 at joint 114 to provide an airtight, vacuum seal. Joint 114 may be formed by brazing, welding, or other similar well-known methods of hermetically joining a vacuum vessel material such as stainless steel to a thermal storage assembly material such as copper or a copper alloy. Allowing thermal storage assembly 88 to form a part of the exterior surface of vacuum vessel 84 may be advantageous in a number of ways. For example, in this embodiment a portion of thermal storage assembly 88 is in direct contact with fluid 66, thus increasing the amount of surface area of the thermal storage assembly in contact with the fluid. This results in increasing the heat transfer capabilities of thermal storage assembly 88.

Additionally, this embodiment of thermal storage assembly 88 beneficially allows transmissive window 102 to be directly mounted to the thermal storage assembly, such as by brazing, welding or other conventional methods. Mounting transmissive window 102 to thermal storage assembly 88 may be advantageous by providing a better interface for forming a vacuum joint, as a typical copper thermal storage assembly forms a reliable, brazed vacuum joint with a typical beryllium transmissive window. On the other hand, joining a beryllium transmissive window to a stainless steel vacuum vessel can be problematic due to the mismatched thermal properties of beryllium and stainless steel, thereby leading to joint failure due to thermal stress. Thus, providing a thermal storage assembly 88 that forms a part of the external surface of vacuum vessel 84 increases the heat transfer rate and reliability of the present invention.

Additionally, thermal storage assembly 88 is beneficially formed to provide for the absorption of thermal energy over a large area. This allows for a smaller average heat flux over the area of interior surface 88*a*. In this regard, central cavity 92 provides for a large surface area of interior surface 88*a* to be directly exposed to focal spot 94, and hence exposed to back scattered electrons 98 and the radiant thermal energy from anode 80. Additionally, the relatively large spacing, compared to the prior art, between interior surface 88*a* of thermal storage assembly 88 and focal spot 94 allows for greater diffusion of back scattered electrons 98 before they are intercepted, greatly reducing the magnitude of the local heat flux on interior surface 88*a*. The calculated heat flux at interior surface 88*a* of the present invention is about 0.7 $W/mm^2$ per 100 mA of current in x-ray generating device 16. For example, for an x-ray generating device having a 570 mA current, the heat flux to the interior surface 88*a* of thermal storage assembly 88 is about 4 $W/mm^2$. Similarly, with currents of 100 mA and 300 mA, the heat flux to the interior surface 88*a* of thermal storage assembly 88 is about 0.7 $W/mm^2$ and 2.1 $W/mm^2$, respectively. This is far lower than typical prior art designs. The present invention still collects virtually the same amount of thermal energy, compared to the prior art, but greatly reduces the complication of the design through the ingenuity of how and where energy is collected. Thus, the large surface area of interior surface 88*a* substantially reduces the average heat flux at internal surface 88*a* as compared to prior art devices that require immediate heat transfer.

Also, thermal storage assembly 88 is preferably at the same electrical potential as anode assembly 80 so that back scattered electrons 98 are not repelled from the thermal storage assembly, thus maximizing the amount of back scattered electrons collected by the thermal storage assembly. Additionally, due to the high electrical conductivity of thermal storage assembly 88, charge is quickly removed to ground, thereby alleviating any charge build-up in x-ray generating device 16.

Interior surface 88*a* of thermal storage assembly 88 is preferably cylindrical and smooth, providing excellent high voltage stability. The smoothness of surface 88*a* avoids small defects or asperities that could cause an unwanted electrical discharge from cathode assembly 82 to body portion 108. Further, the spacing between the interior surface 88*a* and the high voltage cathode assembly 82 shall be sufficient to prevent high voltage breakdown to thermal storage assembly 88.

Further, thermal storage assembly 88 acts to collimate x-rays 96 being transmitted out transmissive window 100 by comprising a substantially non-x-ray-transmissive material and by providing aperture 100. Typically, it is desirable for only x-rays 96 produced at focal spot 94 to exit x-ray generating device 16. Off-focal x-rays may be produced by the collision of back scattered electrons 98 with components within device 16, including areas of anode assembly 80 outside of focal spot 94. These off-focal x-rays may be directed toward transmissive window 102. Also, these diffuse off-focal x-rays degrade image quality and add undesirable heat load to anode 80 and transmissive window 102. Thermal storage assembly 88 substantially prevents these off-focal x-rays from exiting device 16 by providing aperture 100 that acts to collimate x-rays. Aperture 100 may be any shape or dimension suitable to limiting or collimating radiation to provide a beam of x-rays 96 that substantially originates at focal spot 94. Additionally, aperture 100 thermally shields transmissive window 102 by comprising a narrow path disposed in body portion 108 along the path of x-rays 96 from anode 80 to the transmissive window. Thus, aperture 100 dramatically limits the exposure of transmissive window 102 and the adjoining portions of vacuum vessel 84 to the damaging back scattered electrons 98 and radiant thermal energy from anode 80.

As mentioned above, body portion 108 transfers the thermal energy to a coolant fluid 110 circulating through heat exchange chamber 112. Preferably, heat exchange chamber 112 is formed at the periphery of thermal storage assembly 88, away from interior surface 88*a* of the thermal storage assembly that is absorbing the back scattered electrons 98 and radiant thermal energy from anode assembly 80. Heat exchange chamber 112 preferably comprises less than about 40%, more preferably less than about 30%, and most preferably less than about 20% of the volume of thermal storage assembly 88. This arrangement allows the absorbed thermal energy to diffuse throughout the large mass of body portion 108, thereby lowering the heat flux and surface temperature at interface 112*a* between coolant fluid 110 and body portion 108 at the surface of heat exchange chamber 112. For example, using the 4 $W/mm^2$ heat flux at interior surface 88*a* given previously, the corresponding heat flux at coolant interface 112*a* is about 1.2 $W/mm^2$. In other words, the heat flux at coolant interface 112*a* is only about 30% of the heat flux at interior surface 88*a* in an example like this that utilizes the thermal capacity of thermal storage device 88. Therefore, the present invention permits the heat flux at interior surface 88*a* to greatly exceed the heat flux at coolant interface 112*a*. For example, the incoming heat flux may comprise about 100%–333% of the outgoing heat flux. In contrast, typical prior art devices provide a maximum of less than about a 100% relationship between incoming and outgoing heat flux. This is because typical prior art devices have very insignificant thermal storage capacities. The thermal storage capacity of thermal storage assembly 88 advantageously allows such a low heat flux at coolant interface 112*a*. The lower heat flux at coolant interface 112*a* advantageously insures that coolant fluid 110 does not boil. Boiling fluid 110 can have negative implications, such as undesirably large pressure drops, possible coolant degradation, and catastrophic failure of thermal storage assembly 88 due to melting. Additionally, by permitting a greater amount of thermal energy to be absorbed at interior surface 88*a*, the present invention avoids having the heat transfer capacity of fluid 110 limit the amount of residual energy absorbed by heat transfer assembly 88. Thus, the present invention greatly reduces the thermal stress at coolant interface 112*a* for a given heat flux at interior surface 88*a* compared to thin-walled structures.

In the present invention, coolant fluid 110 within heat exchange chamber 112 may be a portion of the body of cooling fluid 66, such as dielectric oil, that is circulated about vacuum frame 84 by pump 54 (FIG. 2). Utilizing the same fluid for fluids 112 and 66 eliminates the need for separate cooling systems and special cooling fluids, as may be disadvantageously required by the prior art. As the circulating fluid 66 exits radiator 68 (FIG. 2), it may be divided into two circulating fluid systems. The first system circulates fluid 66 between vacuum vessel 84 and casing 64 (FIG. 2), while the second system circulates fluid 110 through heat exchange chamber 112 in thermal storage assembly 88. In a preferred embodiment, a portion of the body of fluid 66 forms fluid 110 that is transferred through inlet tube 116 to heat exchange chamber 112 in thermal storage assembly 88. After circulating through heat exchange chamber 112, fluid 110 exits thermal storage assembly 88 at fluid outlet 118, mixing with fluid 66 to be re-circulated. Preferably, inlet tube 116 runs from radiator 68 to thermal storage assembly 88 to insure a reliable flow of cooled fluid 110, although other connections will be readily apparent to one skilled in the art. Thus, the present invention beneficially provides for two separate, circulating cooling systems that advantageously utilize the same fluid.

Additionally, filter 106 protects the thermally-sensitive transmissive window 102 by absorbing back scattered electrons 98 and transferring absorbed thermal energy from hot anode 80 to thermal storage assembly 88, while allowing the transmission of diagnostically-useful x-rays 96. Filter 106 comprises a thin plate of thermally-conductive material that traps the majority of back scattered electrons 98 striking its surface, thereby preventing the back scattered electrons from either returning to anode 80 or striking transmissive window 102. Further, the material of filter 106 is electrically conducting, so that a charge differential does not build up within the filter. Also, filter 106 comprises a material that is physically and chemically stable within the high temperature environment of vacuum vessel 84. Therefore, filter 106 preferably comprises a low atomic number material, such as a material having an atomic number of about 22 and lower, that allows for the transmission of useful diagnostic x-rays. For example, filter 106 may comprise beryllium, common graphite, pyrolytic graphite, titanium, carbon, and aluminum. Common graphite is advantageous because of its relatively high temperature capability. Similarly, pyrolytic graphite is advantageous because of its relatively high thermal conductivity. Thus, filter 106 advantageously reduces the exposure of transmissive window 102 to the residual energy, thereby reducing the thermal stresses within the window.

The method of attachment for filter 106 should be chosen to allow for low resistance heat transfer out of the filter body. Because filter 106 is not a structural part of vacuum vessel 84, however, the filter may be attached to the vacuum vessel in a manner suitable to effectively transfer the thermal energy out of the filter. For example, filter 106 may be fixedly attached at only one side, or the filter may be attached with a loose-fit mounting. Filter 106 is preferably mounted within aperture 100 of thermal storage assembly 88, however, as one skilled in the art will realize, the filter may be independently mounted by any number of known methods within vacuum vessel 84. Preferably, the method of attachment comprises vacuum brazing filter 106 to thermal storage assembly 88, although other similar methods, such as welding, may be utilized. Also, filter 106 comprising common graphite or pyrolytic graphite may be encapsulated in a beryllium carrier to facilitate brazing. For example, a plate of beryllium may be milled out, a plate of graphite inserted, and another plate of beryllium brazed over the graphite to encapsulate it. Finally, as opposed to transmissive window 102, filter 106 does not need to be hermetically sealed to thermal storage assembly 88, but only needs to be mounted in contact with body portion 108 to provide a conductive path for the transfer of thermal energy intercepted by the filter. Thus, filter 106 helps to reduce the thermal stresses within transmissive window 102 and joint 104.

In order to further protect transmissive window 102 from thermal stresses, the anode-facing surface of filter 106 may have a coating layer 119 comprising a thin layer of a highly reflective, high atomic number material. Suitable materials for coating layer 119 include materials having an atomic number greater than 70, such as gold, platinum, and tantalum. The high atomic number characteristic of the material of coating layer 119 serves to re-scatter a large portion of back scattered electrons 98 emanating from anode assembly 80 that impinge on its surface. The fraction of incident electrons back scattered from a surface increases with the atomic number of the material, reaching approximately 50 percent for an atomic number greater than 70. For example, if filter 106 is bare beryllium or carbon, then the filter would absorb greater than 90 percent of the incident electron energy or power. In contrast, filter 106 comprising anode-facing coating layer 119 such as gold (atomic number=79) only absorbs approximately 50 percent of the incident power, with the balance being re-scattered. Similar results are obtained with platinum and tantalum. The preferred thickness of coating layer 119 is sufficient to re-scatter the back scattered electrons 98 incident on filter 106, yet thin enough to transmit the diagnostically useful x-rays 96 without significant attenuation. For example, the thickness of the high atomic number coating layer 119 may be only a few micrometers, and most likely less than about 6 micrometers. An additional benefit of the high atomic number coating is that it attenuates low energy (dose-causing) x-rays. Low energy x-rays are x-rays having a non-useful, non-diagnostic amount of energy. As mentioned above, the level of energy for diagnostically-useful x-rays for a typical computed tomography application ranges from about 60 keV to about 140 keV. Thus, coating layer 119 advantageously lowers the x-ray dose exiting vacuum vessel 84 and x-ray generating device 16, as well as reducing the exposure of transmissive window 102 to the residual energy generated at anode assembly 80.

Additionally, coating layer 119 acts to reflect nearly all of the incident thermal radiation emitted by the hot anode assembly 80. For example, filter 106 having a coating layer 119 comprising gold reflects more than 99 percent of the incident thermal radiation. Thus, as a result, the anode-facing, high atomic number coating layer 119 beneficially improves the shielding provided by filter 106 for transmissive window 102 from back scattered electrons 98 and thermal energy from hot anode assembly 80.

A number of embodiments of the present invention are discussed below. Note that throughout the figures, similar elements have the same reference numeral.

Figure 5:
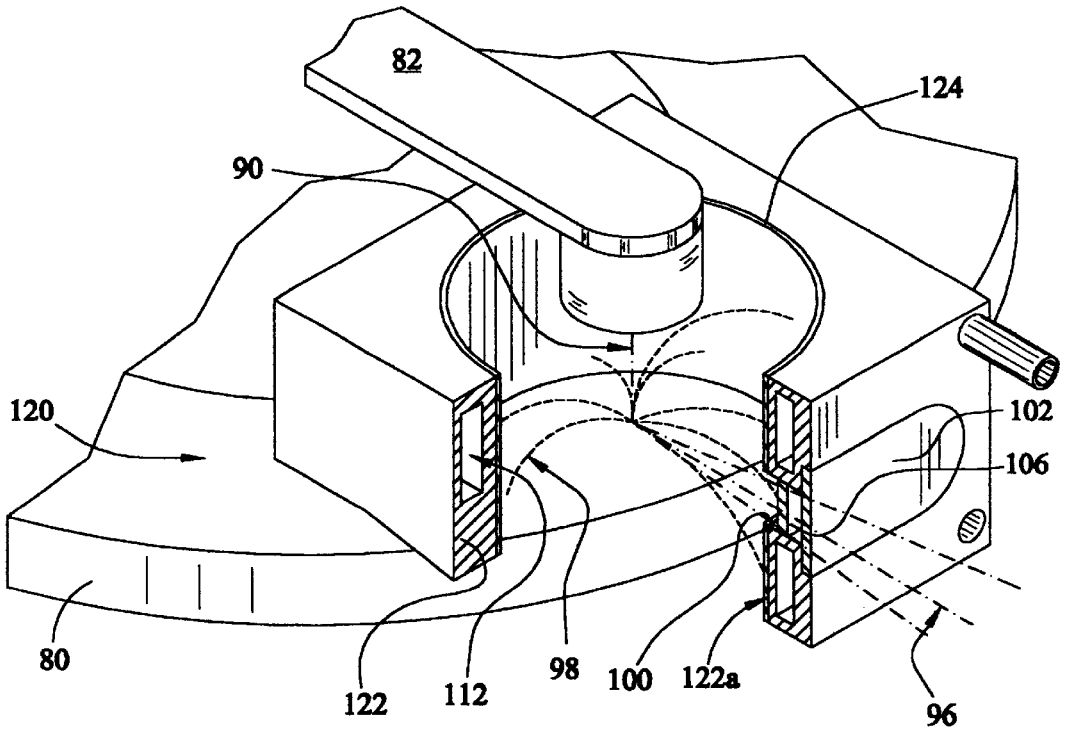
FIG. 5 is a sectional perspective view of another embodiment of an x-ray generating device incorporating a thermal storage assembly of the present invention with a coating layer on its interior surface.

Referring to FIG. 5, in another embodiment of the present invention, a thermal storage assembly 120 comprises a body portion 122 having coating layer 124 disposed on interior surface 122*a* to provide a desired emissivity. Coating layer 124 may comprise a material having a lower atomic number than the material of body portion 122, as well as high temperature capabilities and low electron back scatter characteristics. Suitable materials for this type of coating layer 124 may comprise beryllium or a carbon-containing material. The lower atomic number of coating layer 124 enables the coating layer to absorb a larger fraction of the incident back scattered electron energy than the bare interior surface 120*a* of body portion 122. Alternatively, coating layer 124 may comprise a material having a higher atomic number than the material of body portion 122. Preferably, coating layer 124 is a material having an atomic number greater than about 70, such as gold or tungsten. The higher atomic number of coating layer 124 causes greater secondary back scatter, resulting in lower absorbed heat flux within body portion 122. Similarly, the internal coating layer 124 may also be beneficial if it has a higher emissivity than the material of body portion 122. A higher emissivity coating layer 124 allows for greater absorption of radiant thermal energy, such as from hot anode assembly 80. Examples of suitable high emissivity coating layer materials include carbon, iron oxide, Rene 80, and numerous other examples evident to one skilled in the art. Coating layer 124 may be applied to interior surface 122*a* using known processes, such as thermal spray, chemical vapor deposition (CVD) and sputtering. Thus, utilization of coating layer 124 allows for some engineering of the magnitude of the collected heat flux on the interior surface.

Figure 6:
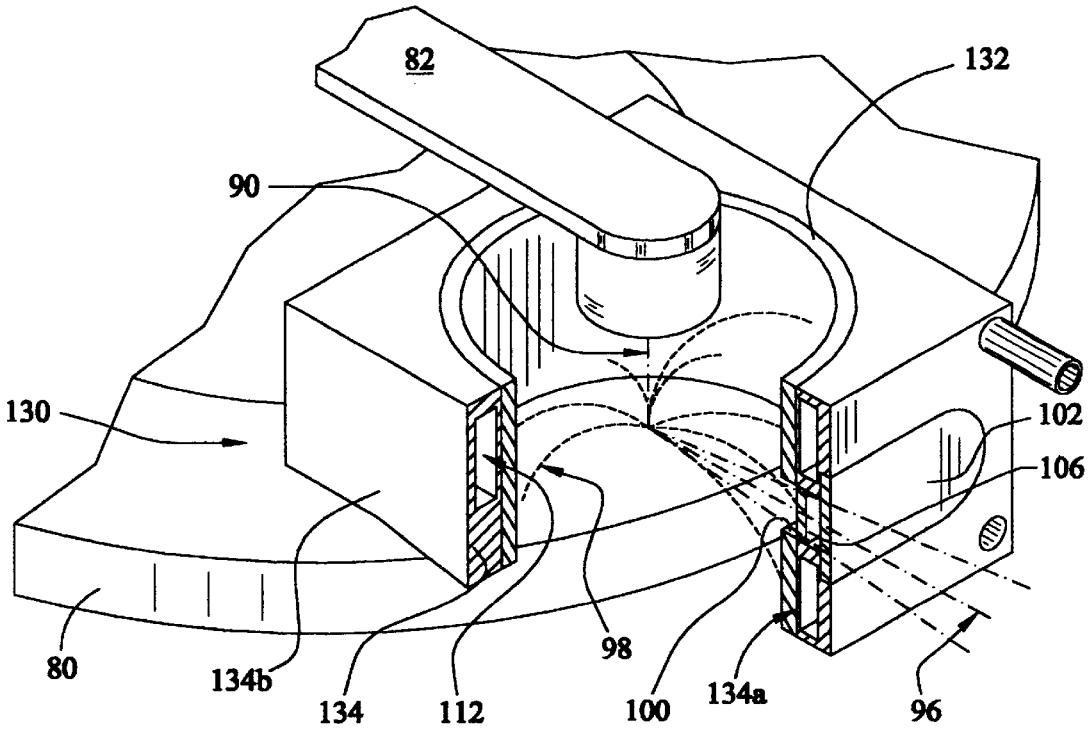
FIG. 6 is a sectional perspective view of yet another embodiment of an x-ray generating device incorporating a thermal storage assembly of the present invention with a sleeve on its interior surface.

Referring to FIG. 6, according to another embodiment of the present invention, a thermal storage assembly 130 may further comprise a sleeve member 132 to provide additional x-ray attenuation. Sleeve member 132 may be mounted to interior surface 134*a* of body portion 134, such as by vacuum braze or shrink-fit. Sleeve member 132 is preferably constructed of a material with an atomic number greater than 70, preferably tungsten, to provide a high degree of x-ray attenuation. Sleeve member 132 advantageously provides local x-ray radiation shielding, being positioned close to the source of x-rays 96. The positioning of thermal storage assembly 130, including sleeve member 132, beneficially intercepts a significant portion of x-rays 96 and back scattered electrons 98 emanating in all directions from anode 80. This reduces the stray radiation within vacuum vessel 84 (not shown). As a result, the thick lead coating typically applied to the internal surface of casing 64 (FIG. 1) may be reduced or eliminated. The reduction or elimination of the lead coating results in a tremendous weight savings. As one skilled in the art will realize, sleeve member 132 may be disposed adjacent to internal surface 134*a* or external surface 134*b* of body portion 134. One advantage of placing sleeve member 132 adjacent to interior surface 134*a*, however, is that this placement allows inner sleeve 132 to directly absorb incident electron energy from back scattered electrons 98 and radiant thermal energy from hot anode 80 and transfer this thermal energy to body portion 134 and out of the system through coolant fluid 110 (not shown).

Figure 7:
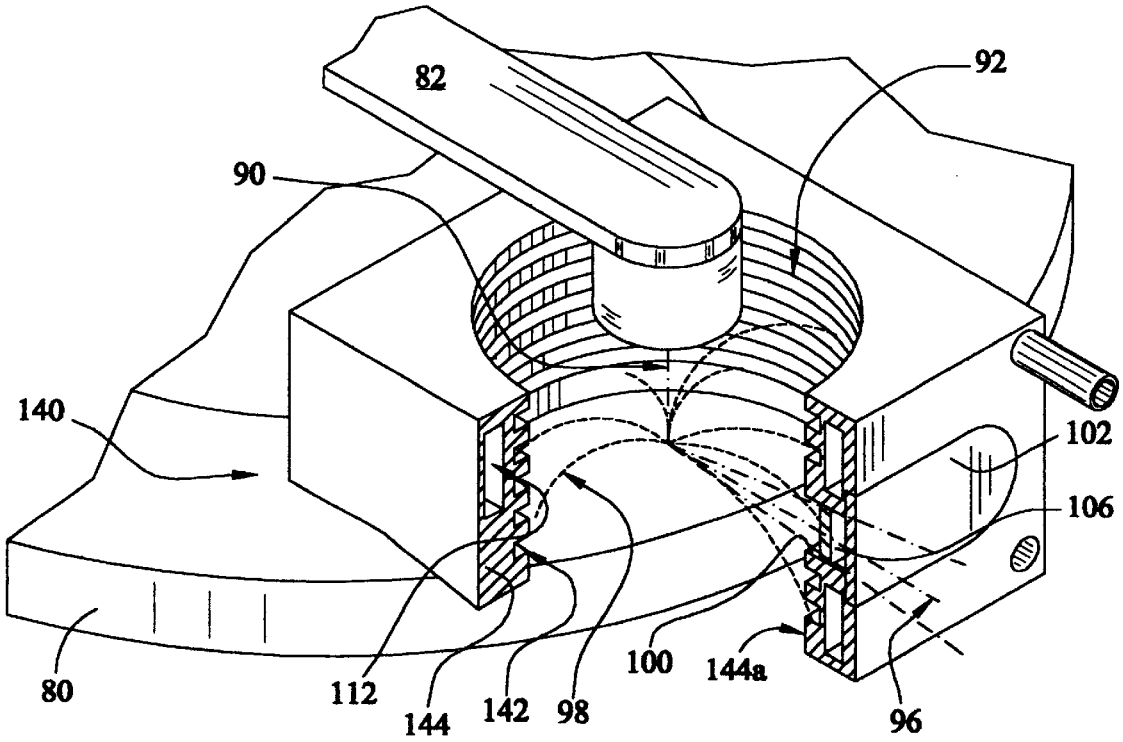
FIG. 7 is a sectional perspective view of a further embodiment of an x-ray generating device having a thermal storage assembly comprising high aspect ratio slots on its interior surface.

Referring to FIG. 7, according to another embodiment of the present invention, a thermal storage assembly 140 may comprise a plurality of high aspect ratio slots 142 formed on interior surface 144*a* of body portion 144. High aspect ratio slots 142 may be at any angle, but are preferably parallel (not shown) or perpendicular to the path of the stream of electrons 90 entering central cavity 92 from cathode assembly 82 to anode assembly 80. High aspect ratio slots 142 may be machined, cast or otherwise formed by well-known manufacturing methods.

Figure 8:
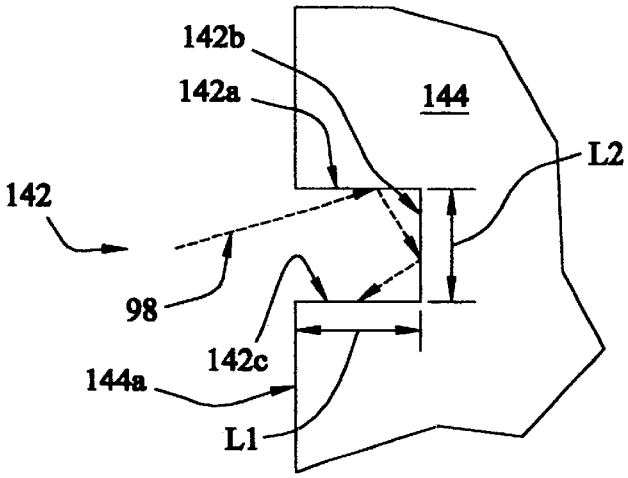
FIG. 8 is a detail view of a high aspect ratio slot in a thermal storage assembly receiving a back scattered electron.

Referring to FIG. 8, high aspect ratio slot 142 increases the surface area of interior surface 144*a*, correspondingly increasing the absorption of back scattered electrons 98 and radiant thermal energy from anode 80, while reducing the average thermal flux across the entire interior surface. In FIG. 8, a back scattered electron 98 approaches slot 142 and impacts surface 142*a*, where it may be absorbed and converted to heat, or back scattered. If it is back scattered, it may impact surface 142*b*, where it may again be absorbed or back scattered. Again, if it is back scattered, it may impact surface 76*c*. As electron 98 back scatters, it loses a portion of its energy as heat into the back scattering surface. The presence of slot 142 increases the number of possible back scattering events over a smooth surface, thus increasing the heat deposition into the surface. Further, the total number of possible back scattering events are increased by increasing the ratio of slot length L1 to slot width L2, thereby effectively trapping electron 98 in slot 142. These high aspect ratio slots 142 increase the effective thermal emissivity by trapping incident electron energy and providing greater surface area, compared to a flat surface, for thermal energy transfer. Alternatively, a less expensive method of increasing thermal emissivity of interior surface 144*a* is to sand or grit blast the surface to create a pitted surface. Although this description depicts an electron, one skilled in the art will realize that an analogous process takes place for radiant thermal energy (photons) which approach slot 142.

In summary, one feature of the present invention is to provide an x-ray generating device with improved thermal performance and duty cycle by preferentially absorbing and storing back scattered electrons and radiant thermal energy. Another feature greatly reduces off-focal radiation and non-diagnostic dose to the patient by reducing and collimating off-focal radiation. Another aspect of the invention reduces the heat flux from back scattered electrons and radiant energy to reduce any detrimental heating of the x-ray transmissive window. Finally, another aspect of the invention provides large thermal storage and removal capability to eliminate the need for cooling delays during the radiographic exam.

Although the invention has been described with reference to these preferred embodiments, other embodiments can achieve the same results. Variations and modifications of the present invention will be apparent to one skilled in the art and the following claims are intended to cover all such modifications and equivalents.

What is claimed is:

1. An x-ray system, comprising:

a housing unit; and an x-ray generating device disposed within said housing unit, said x-ray generating device comprising:

a cathode adapted to produce a stream of electrons;

an anode adapted to receive said electrons and generate x-rays and residual energy, said residual energy comprising radiant thermal energy from said anode and kinetic energy of said electrons that back scatter from said anode;

a vacuum vessel containing said anode and said cathode;

an x-ray transmissive window, disposed in said vacuum vessel, for allowing said x-rays to exit said vacuum vessel; and a filter disposed between said anode and said window, said filter comprising an x-ray transmissive material that reduces the exposure of said window to said residual energy.

2. An x-ray system as recited in claim 1, wherein said x-ray system is selected from the group comprising computed tomography, radiography, fluoroscopy, vascular imaging, mammography, mobile x-ray imaging, dental x-ray imaging, and industrial x-ray systems.

3. An x-ray generating device, comprising:

a cathode adapted to produce a stream of electrons;

an anode adapted to receive said electrons and generate x-rays and residual energy, said residual energy comprising radiant thermal energy from said anode and kinetic energy of said electrons that back scatter from said anode;

a vacuum vessel containing said anode and said cathode;

a window disposed in said vacuum vessel for allowing said x-rays to exit said vacuum vessel, said window comprising an x-ray transmissive material; and a filter disposed between said anode and said window, said filter comprising an x-ray transmissive material that reduces the exposure of said window to said residual energy.

4. An x-ray generating device as recited in claim 3, wherein said filter comprises a material having an atomic number of 22 or less.

5. An x-ray generating device as recited in claim 4, wherein said filter comprises a material selected from the group consisting of beryllium, common graphite, pyrolytic graphite, titanium, carbon and aluminum.

6. An x-ray generating device as recited in claim 5, wherein said filter comprises graphite encapsulated in a beryllium carrier.

7. An x-ray generating device as recited in claim 3, further comprising:

a thermal storage assembly disposed between said anode and said cathode to absorb an amount of said residual energy, said thermal storage assembly having a body portion of a sufficient thermal capacity to permit the rate of transfer of said amount of said residual energy absorbed into said thermal storage assembly to substantially exceed the rate of transfer of said amount of said residual energy out of said thermal storage assembly.

8. An x-ray generating device as recited in claim 7, wherein said thermal storage assembly further comprises an aperture, adjacent to said anode, providing a passage for said x-rays to exit said x-ray generating device and adapted for collimating said x-rays.

9. An x-ray generating device as recited in claim 8, wherein said window is hermetically sealed within said aperture to said thermal storage assembly, and wherein said thermal storage assembly is hermetically sealed to said vacuum vessel.

10. An x-ray generating device as recited in claim 9, wherein said filter is mounted within said aperture, said mounting effective to provide thermal conductance between said filter and said thermal storage assembly.

* * * * *